United States Patent [19]

Palus et al.

[11] Patent Number: 4,767,218

[45] Date of Patent: Aug. 30, 1988

[54] MIXING PADDLE ASSEMBLY

[75] Inventors: Joseph J. Palus; Robert E. Williams, both of Plymouth, Wis.

[73] Assignee: Stoelting, Inc., Kiel, Wis.

[21] Appl. No.: 45,821

[22] Filed: May 4, 1987

[51] Int. Cl.[4] ..... B01F 13/00

[52] U.S. Cl. ..... 366/261; 366/276

[58] Field of Search ..... 366/64, 66, 67, 241, 366/255, 256, 261, 276, 331, 332, 333, 334, 335, 342, 343, 348, 349, 309, 312, 313, 325, 328

[56] References Cited

U.S. PATENT DOCUMENTS

| | | | |
|---|---|---|---|
| Re. 30,237 | 3/1980 | Born | 366/261 |
| 267,211 | 11/1882 | Jenks . | |
| 707,261 | 8/1902 | Ruttkamp . | |
| 852,114 | 4/1907 | Gowan . | |
| 2,027,756 | 1/1936 | Tay | 366/312 |
| 3,193,929 | 7/1965 | Collins | 366/312 |
| 3,476,364 | 11/1969 | Thomson . | |
| 3,689,033 | 9/1972 | List | 366/309 |

FOREIGN PATENT DOCUMENTS

| | | | |
|---|---|---|---|
| 433397 | 4/1948 | Italy | 259/104 |

*Primary Examiner*—Harvey C. Hornsby
*Assistant Examiner*—J. Dwight Poffenberger, Jr.
*Attorney, Agent, or Firm*—John C. Cooper, III; Fred Wiviott; C. Thomas Sylke

[57] ABSTRACT

The present invention comprises a mixing paddle assembly which may be used with a variety of mixing devices, but which is especially useful with devices which include a motorized carriage adapted to move along a beam spaced above an elongate mixing vat. Depending from the carriage are a pair of shafts, and within the carriage a separate motor is adapted to move the shafts upwardly and downwardly as the carriage moves along the beam. The mixing paddles of the present invention are affixed to the end of such shafts. The improved paddle assemblies of the present invention include a pair of plastic blades mounted to a blade assembly which includes laterally extending, stationary pegs residing in arcuate slots of pivotably supported end plates, so that the blades may be freely rotated on supporting shafts to be angled differently on the forward and return passes of the paddles. The supporting shafts extend substantially normal to the axis of the respective depending shaft. The slant of the blades insures that the blades will knife down to the floor of the vat without damage to delicate process materials, such as cottage cheese curd. The other blade also participates in the mixing procedure. Movement of the paddle assembly from one operating position to another operating position is caused by a change in direction of movement of the depending shaft to which the paddle is attached.

21 Claims, 2 Drawing Sheets

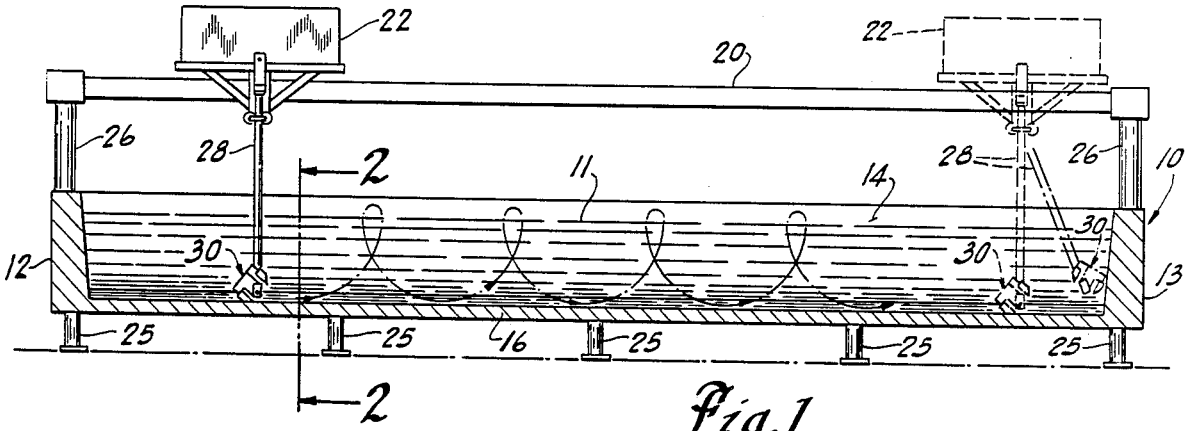
Fig.1
Fig.2
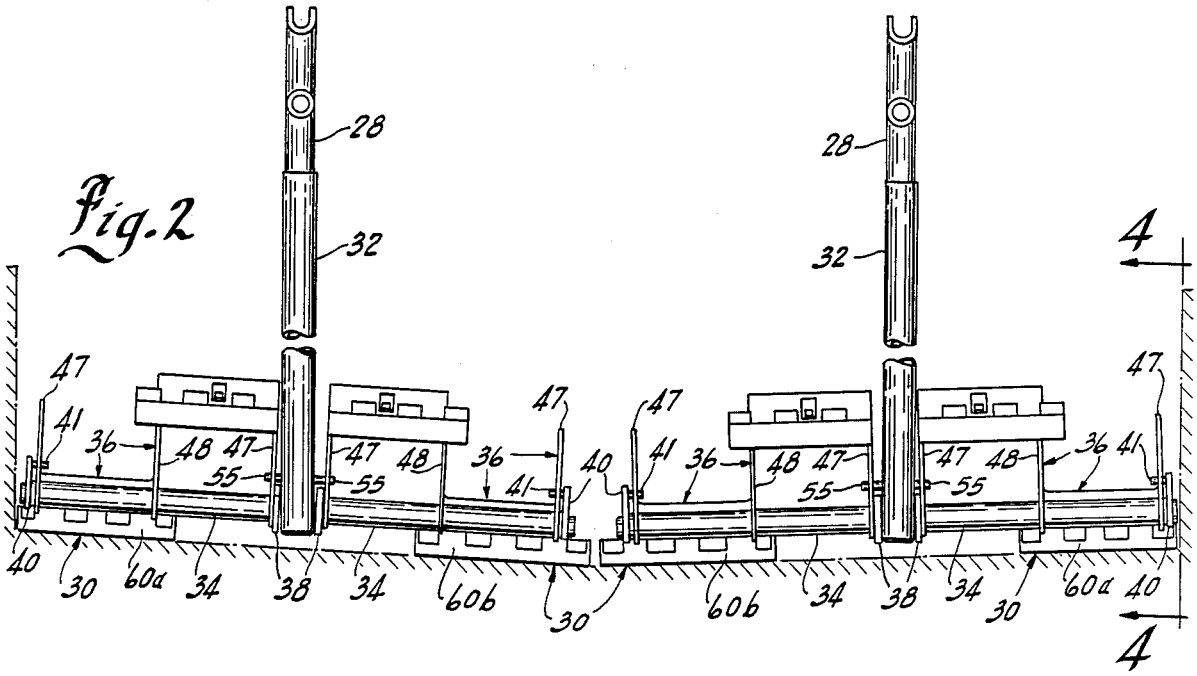
Fig.4
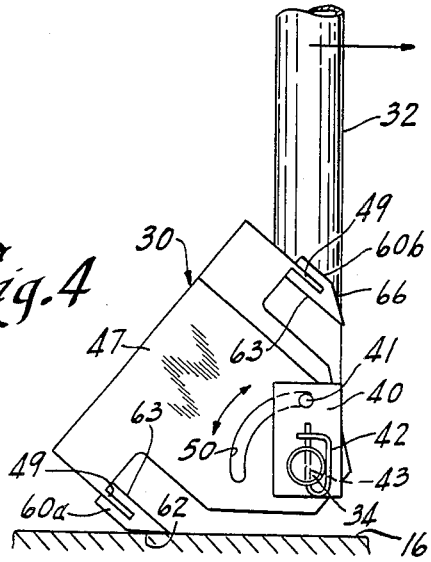
Fig.5
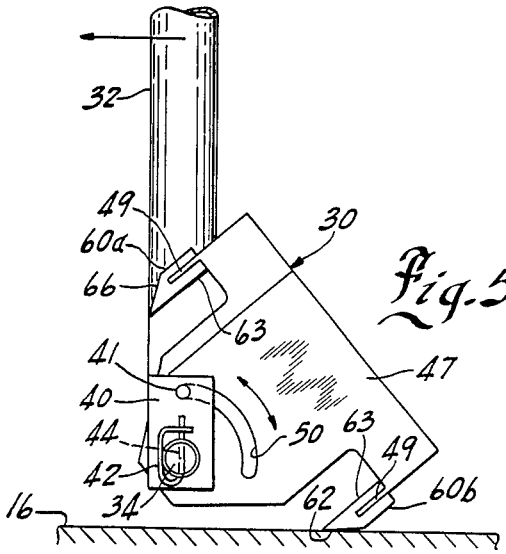

MIXING PADDLE ASSEMBLY

BACKGROUND OF THE INVENTION

1. Field of the Invention

The present invention relates generally to the art of mixing paddles and more specifically to the art of paddles used for mixing two or more components in a vat. Still more specifically, the preferred embodiment of the present invention relates to a mixing paddle for use in creaming of cottage cheese curd, and which permits extremely effective mixing and which does not damage the relatively delicate curd particles.

2. Description of the Prior Art

Numerous processing devices are known to the art for mixing process materials in a vat or other container. One illustrative type of process is the processing of cottage cheese, but it should be understood at the outset that the mixing paddle of the present invention has numerous other applications. These will become apparent to those skilled in the art after the present invention has been described.

Problems with prior art mixing machines, and mixing paddles in general, include the ability of the machines to adequately mix all the materials contained in the vat, e.g. the ability to pick up and dispense and mix the process materials located at the bottom, ends and corners of the vat. Furthermore, most prior art mixing machines are not entirely suitable if one of the process materials to be mixed is delicate, e.g. the curd particles of cottage cheese. Agitation of the process materials throughout the depth of the vat is also a problem resulting in a final product having varying degrees of mix consistency. Many prior art mixing paddles are of the push variety, in which cases relatively small paddles have to be used due to the large blade loads. Stirring paddles used in the past include those discussed below, as well as those described in U.S. Pat. Nos. 3,476,364 and 3,490,751 assigned to the assignee of the present invention.

The prior art known to the present inventors to which the invention is most closely related is the "Wing Iype Agitator" shown in U.S. Pat. No. Re. 30,237, reissued Mar. 25, 1980 to Born. In this device, an agitator carriage is supported above and is powered for oscillatory movement along the length of a rectangular, elongate vat. A pair of stirring blades depend below the carriage into the vat and overlap one another in the vat for more complete mixing. Each blade is supported to move through a generally circular path in a vertical plane, and the blades are rotated independently of the motor which drives the carriage along the length of the vat, resulting in each blade having both vertical and horizontal components as it moves through the vat. By varying the speed of the carriage motor and the blade motor, loops of movement are created by mixing paddles carried on the lower ends of the blades, which loops can vary from being generally circular in shape to a pattern which is more undulating. Some limited pivoting of the paddles is permitted with this device, but it still suffers from two significant drawbacks. These drawbacks are first the tendency of the paddles to push down onto (crush) the cottage cheese curds and the fact that the paddles do not entirely mix the processing materials in the vicinity of the ends and end corners of the vat, as well as scraping the bottom. The latter problem leads to the need to employ laborers to manually assist in the mixing process.

Other examples of mixing devices known prior to the present invention include the "Cheese Making Apparatus" shown in Jenks' Nov. 7, 1882 U.S. Pat. No. 267,211. In this device a cheese curd cutter includes a rod or shaft having an agitator at its lower end. The shaft can be rotated about its axis and reciprocated in a longitudinal plane.

Another "Mixing Machine" is described in U.S. Pat. No. 707,261 issued to Ruttkamp on Aug. 19, 1902. In this patent a semi-circular tank is used to contain the processing materials and a beam is supported on the top of the tank. The beam supports a windmill like blade which rotates in a vertical plane. The device discloses a mechanism for reversing the movement of the mixing rotator.

Gowan, in his U.S. Pat. No. 852,116 issued Apr. 30, 1907 for "Agitator" describes a dasher which swings and is reciprocated and which includes wing-like elements set at an angle with respect to one another. The patentee indicates that this device works cottage cheese curd vertically and longitudinally in a vat.

A "Stirring Paddle Assembly For Process Vat" is shown in Thomson's U.S. Pat. No. 3,476,364 issued Nov. 4, 1969. In this device for cheese processing, a single stirring blade is connected to and trails each arm of a paddle assembly. The blade extends substantially above the bottom of the vat so that areas above the bottom will be stirred as a central rotating hub, to which the arms are attached, is moved transversely above and along the vat.

While each of the foregoing patents identifies the need for improvement in mixing efficiency, some even for delicate process materials, they all suffer from one or more drawbacks such as those discussed at the first part of this section of the specification. A mixing assembly which includes an improved mixing paddle to overcome such drawbacks would represent a substantial advance in the art.

OBJECTS AND SUMMARY OF THE INVENTION

It is a principal advantage of the present invention to provide an improved mixing paddle assembly for use with machines designed to mix processing materials and which overcomes the aforementioned disadvantages of the prior art.

Another object of the present invention is to provide a mixing paddle assembly which can readily be adapted to a number of different applications and used for mixing a variety of processing materials.

Yet another object of the present invention is to provide a mixing paddle assembly which provides overall mixing efficiency and improved mixing in those portions of a mixing vat which have previously been difficult to reach with prior art mixing paddles.

A further object of the present invention is to provide a mixing paddle assembly which may be used with relatively delicate processing materials, such as cottage cheese curd.

A still further object of the present invention is to provide an improved mixing paddle assembly for use in mixing cream dressing with cottage cheese curd to provide a creamed cottage cheese product.

A different object of the present invention is to provide a mixing paddle assembly for mixing systems which reduces costly manual labor steps in the processing of materials in a vat or tank.

How these and other objects of the present invention are accomplished will be described in the following detailed description of the preferred embodiment, taken in conjunction with the drawings. Generally, however, the objects are accomplished in a mixing device generally similar to that of the aforementioned Born patent, except that a different mixing paddle assembly is used therewith. The preferred embodiment of the novel mixing paddle assembly described and claimed herein includes a stationary paddle support shaft extending laterally relative to and coupled to the shaft depending from the traversing carriage. To this shaft are rotatably supported paddle assemblies including a paddle blade support member providing a pair of oppositely facing, adjoining U-shaped, integral supporting portions for supporting a pair of paddle blades. The laterally extending shafts each include a statonary end cap with an inwardly extending peg slidably engagable with an arcuate slot defined in an end defined by a respective U-shaped support portion plate member. During movement of the carriage in one direction, the paddle blade of a U-shaped portion of the mixing paddle assembly are pulled downwardly due to the angle of the blade and the fact that the pivot point (stationary paddle shaft) of the blade support member is ahead of the scraper/mixing blade. When the carriage reaches an end of the mixing vat, the blade support member rotates about the shaft so that the opposite paddle blade is utilized for scraping of the vat floor on the return pass. During the return pass, tte second blade will be forced downwardly into the media contained in the vat, due to the fact that the pivot point is once again ahead of the blade. The overall blade construction further contributes to the mixing efficiency of the device because it is relatively deep and capitalizes on the mixing advantages inherent in the design of the Born system discussed above. Other ways in which the objects of the invention are accomplished will become apparent to those skilled in the art after he following detailed description is read and understood. Such other ways are intended to fall within the scope of the present invention.

DESCRIPTION OF THE DRAWINGS

FIG. 1 is a side perspective view of a cottage cheese curd creaming vat illustrating in general terms one potential use for the mixing paddle assembly of the present invention;

FIG. 2 is a front plan view of one pair of the mixing paddle assemblies shown in FIG. 1;

FIG. 4 is an end view taken along the line 4—4 of FIG. 2 showing one pivoted location of the mixing paddle assembly;

FIG. 5 is a view similar to FIG. 4, except illustrating the mixing paddle assembly pivoted to its reverse or alternate position;

In the drawings, like reference numerals are used to illustrate like components.

DETAILED DESCRIPTION OF THE PREFERRED EMBODIMENT

Figure 3:
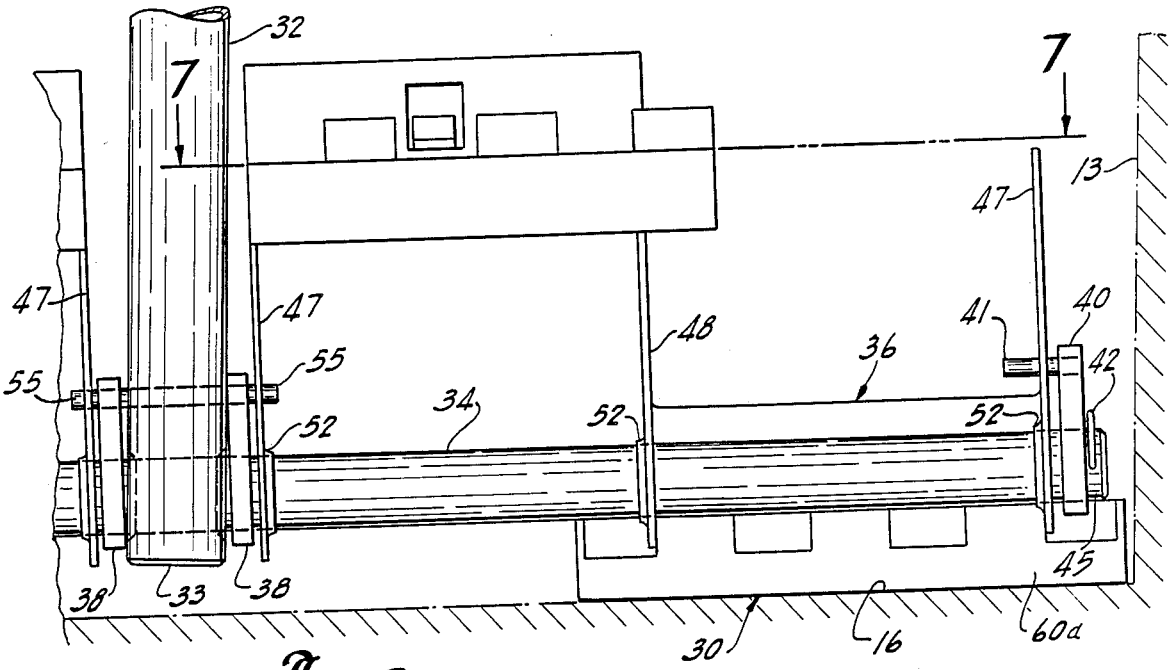
FIG. 3 is an enlarged fragmentary plan view of a portion to the right of FIG. 2, illustrating operating details and supporting structure of the mixing paddle assembly.

Before proceeding to the detailed description of the preferred embodiment, it should be mentioned that the mixing paddle assembly of the present invention can be used to mix a variety of processing materials. Its illustrated use as a paddle for mixing the cream dressing for cottage cheese curds should be taken as illustrative rather than as limiting.

FIG. 1 shows a conventionally shaped vat 10 used in the preparation of a media 11 such as the ingredients for preparing cottage cheese. The vat has a front wall, end walls 12 and 13, a side wall 14, a bottom 16 and an open top. The bottom 16 preferably slopes upwardly from its longitudinal center line towards each side wall 14. Suspended above the top of vat 10 is a beam member 20 on which a carriage 22 rides. Tank 10 is supported abcve the floor by a plurality of legs 25 and the beam member 20 is supported above the tank 10 by columns 26.

The carriage 22, itself, is similar to that shown in the Born U.S. Pat. No. Re. 30,237 and will not be described in detail here. The disclosure of that Reissue patent is expressly incorporated herein by this reference as to the mechanical components contained therein. It will be sufficient for present purposes to merely point out that carriage 22 moves back and forth along beam member 20 at a rate which may be controlled by the operator of the system. Depending from carriage 22 are a pair of shafts 28 which are coupled internally of carriage 22 to drive mechanisms (not shown) which are independent of the drive components used to move carriage 22. The details of these shaft drive components are not shown in detail because they are identical to those shown in the Born patent. As was discussed previously in connection with the description of the Born patent, the shaft drive components cause the shafts to move upwardly and downwardly as carriage 22 moves along the vat 10, and are preferably designed to cause one shaft to be in its lowermost position while the other shaft is in its highest position, and vice versa. The result is the same type of looping movement of the mixing paddles soon to be described as occurs with the Born design and the ability to change the loops from nearly circular to more undulating, all as described in Born.

Figure 6:
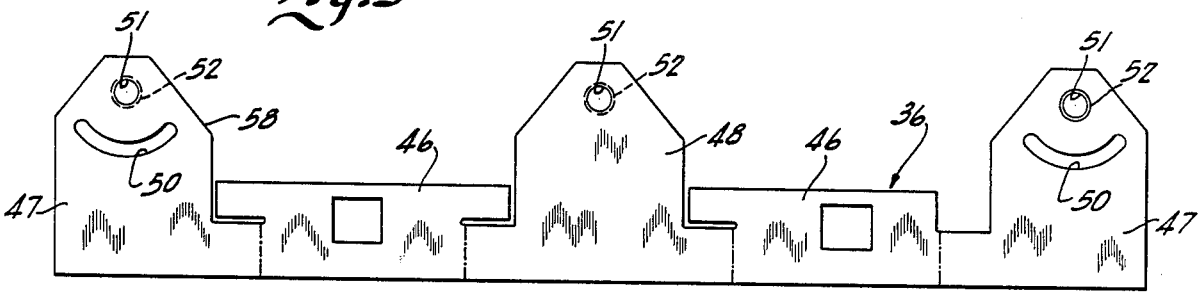
FIG. 6 is a plan view of a blank cut from sheet stock to be formed into the paddle support member of FIG. 7.
Figure 8:
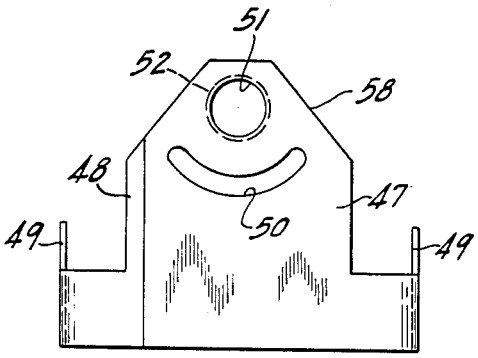
FIG. 8 is an end view illustrating in detail the end plate viewed from the left of FIG. 7.
Figure 7:
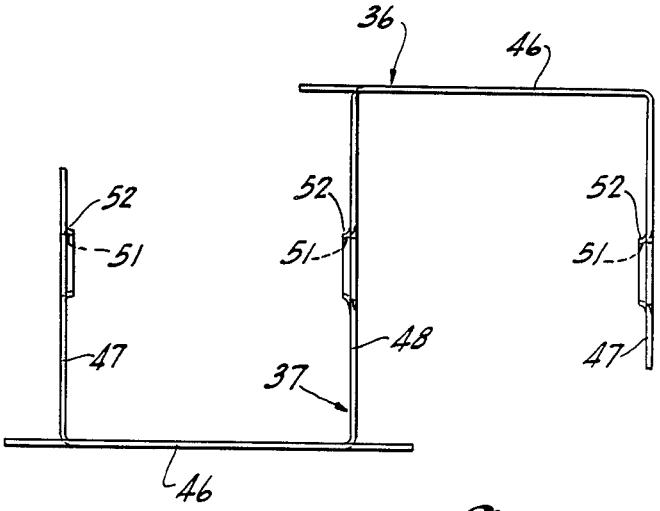
FIG. 7 is a top plan view of the paddle support member bent and formed from the blank illustrated in FIG. 6.

The mixing paddle assemblies 30 of the present invention are shown in FIGS. 2–5, with particular details of a paddle support member 37 being shown in FIGS. 6–8. Each paddle assembly 30 includes a tubular shaft 32 adapted to slide over and be secured in any suitable manner to the aforementioned shafts 28. Height adjustment is therefore made possible to insure that mixing in a particular vat 10 occurs at the bottom of the vat. Shafts 32 are welded at their opposite ends 33 to a paddle shaft 34 to form a T-shaped structure, the paddle shaft 34 being generally cylindrical in shape. The shafts 34 may be angular disposed relative to the shaft 32, if desired, and as shown, to permit paddles with scraper blades to conform to the sloped surface of the bottom 16 of the vat 10. With particular attention to FIG. 3, it will be observed that, on either side of shaft 34 a blade assembly 36 is rotatably mounted on shaft 34. Blade assemblies 36 are spaced from the respective depending shafts 32 by a pair of spacer members 38 and are maintained on shaft 34 by a pair of end caps 40 which slide over shaft 34. A peg 41 extends laterally relative from the end cap 40. Retaining spring clips 42 are located in respective registering holes 43 and 44 of the shaft 34 and an integral, laterally extending bushing portion 45 of the end caps 40.

Blade assemblies 36 include a novel paddle support member 37 which is blanked and formed from a suitable plate material, typically stainless steel. The unitary stamping is bent and formed as shown in FIGS. 6–8 to provide adjoining, oppositely facing U-shaped portions, each portion defining a base 46, spaced apart, parallel end plates 47 and an intermediate, parallel supporting plate 48. The end plates 47 each include an annular slot 50 concentric with, but spaced apart from the axis of the shaft 34 (see FIGS. 4 and 5). The shaft 34 is freely received by axially aligned blanked apertures 51, further defined by integrally formed hubs 52 in the respective end plates 47 and the intermediate plate 48. The slots 50 are equal in length for each end plate 47 and pass through an arc of approximately 90°. The inner end plate 47 (with respect to FIGS. 2 and 3) is designed so that its slot 50 slidably receives a laterally projecting peg 55 welded to the shaft 32 just above the spacer rings 38.

The final components of the blade assemblies 36 are a pair of scraper blades **60*a* and 60*b* which are elongate and are preferably made of a plastic material. Each blade 60 extends over and is secured by conventional means to the extensions 49 of the respective base portions 46 of the assembly 36. As seen in FIGS. 4 and 5, the blades 60 are pointed and arranged so that flat sides 62 and 66 of blades 60*a* and 60*b*, respectively, will be provided and arranged to be generally parallel to the tank bottom 16**.

As stated previously, each blade assembly 36 is constructed to provide adjoining inner and outer U-shaped, oppositely facing, portions. The respective slots 50 are also offset by 90° so that the blade assemblies will operate in the manner now to be described.

In explaining the operation of the paddle assemblies 30, it should first be mentioned that it is preferred to use the Born design concept of having one shaft at its lowermost position while the other shaft is at its uppermost position. Accordingly, FIG. 2 is shown with assemblies 30 located immediately adjacent one another only for illustrative purposes. Furthermore, as explained in Born, it is desirable to provide some overlap between the paddle assemblies 30 of one shaft with those of the other shaft to insure optimum mixing of the processing materials, in this case the cottage cheese curd with the creamy dressing.

The entire blade assembly 36, including the end plates 47, the intermediate plate 48 and the attached blade **60*a* and 60*b*, are freely rotatable with respect to the shaft 34. Thus, the shaft 34 acts as a pivot point and is located forwardly of the blades 60*a*, 60*b* depending cn the alternate directions of operation with respect to the illustrations of FIGS. 4 and 5. The location of the pivot point (shaft 34) in relation to the paddle causes the blades 60*a*, 60*b* to knife downwardly through the media 11 on the downward stroke, thereby avoiding damage to the delicate product. Near the bottom of the stroke the paddle blade 60*a* (see FIG. 4) contacts the bottom 16 of the vat 10 and lifts the product off of the vat bottom 16, thereby accomplishing complete stirring of all of the product. During the upward stroke the motion of the paddle is restricted by the pin 41 to cause a lifting of the product resulting in a vertical stirring action that thoroughly mixes the media, such as the cream dressing into the cottage cheese. Viewing FIG. 4, it will be seen that the scraper blade 60*a* of the inner end plate 47 is in a lowered position with respect to the bottom 16 of the vat 10, with the protruding peg 41 of the end cap 40 located at the top of the slot 50. While not visible in this figure, the peg 55 extending from the shaft 32 will be at the bottom of the slot 50 of the inner plate 47. As the shaft 32 is moved to the right with respect to FIGS. 1 and 4, and due to the configuration of the blade assemblies 36, the assembly 36 will be rotated in a counter clockwise direction about the shaft 34 relative to FIG. 4. Thus, as the shaft 32 is moved against the resistance of the media 11 contained in the vat 10, the forces exerted against the base 46 and the inner surface 63 will cause the blade 60*a* to scrape against the bottom 16 of the vat 10 each time the shaft reaches its lowermost position. Further rotation will be stopped by the peg 41 abutting the end of slot 50. Such will be the case as long as the pulling direction of the shaft is to the right with respect to FIGS. 1 and 4**.

Once the shafts 32 have reached the right end of the vat 10 and the carriage direction is reversed to move to the left, with consequent movement of shafts 32 to the left, the pulling force exerted at the axis of shaft 34 will cause the blade assembly 36 to rotate 90° to the position shown in FIG. 5, wherein the blade **60*b* which was previously in a raised position in FIG. 4, now, becomes the lower or vat bottom scraping blade during the return travel of carriage 22. Upon reaching the left end of vat 10**, the process is repeated, and so on.

It should now be appreciated that the novel mixing device of the present invention provides numerous advantages over the prior art systems. Primarily, mashing of delicate processing materials, such as cottage cheese curd, is prevented, because the blades have a downward slant and are "pulled" toward the vat bottom 16 with a slicing type motion, rather than a pushing type motion of prior devices.

It is also within the scope of this invention to provide a mixing paddle assembly for a circular mixing tank (not shown) wherein the assembly is supported to travel in a continuous circular path around the tank. In this case, because there would be no need to reverse direction only one scraper blade **60*a* or 60*b* for each blade assembly 36 would be required. Again, the alternating pair of assemblies 36** would be provided to provide the desired looping movement of the paddle assemblies.

What is claimed is:

1. In a mixing apparatus of the type described, and including a vat having a bottom surface for supporting media to be mixed in said vat, a carriage, means supporting the carriage for alternatively opposed horizontal movement in a plane generally parallel with the longitudinal plane of the said bottom surface, support means depending from said carriage in an oscillating movement relative to said vat and during said horizontal movement of the carriage; the combination therewith of an improved mixing paddle assembly comprising:

a stationary pivot support member;

paddle blade support means pivotally supported by said pivot support member for alternative rotation in opposed arcuate directions depending upon the direction of horizontal movement of said carriage;

rotational stop means for limiting rotation of said paddle blade support in said opposed arcuate direciton;

a first and a second scraper blade, each blade being fastened to and supported by said paddle blade support member and laterally spaced from the pivot point defined by said pivot support member; and whereby, during horizontal movement of said carriage in a predetermined horizontal direction, forces exerted by said media against said paddle blade support means and said first scraper blade causes said first scraper blade to rest against the said bottom surface and wherein rotational motion of said paddle blade support means is restricted by said rotational stop means to cause lifting of media ingredients resulting in a vertical stirring action of the media, and wherein horizontal movement in an opposite direction causes the media to force and reverse the blade support means to rotate on its axis to present the second blade for scraping action against said bottom surface.

2. The improved mixing paddle assembly of claim 1, wherein the said stationary pivot support is located forwardly of a respective scraper blade when said blade is resting on said bottom surface.

3. The improved mixing paddle assembly of claim 1, wherein said stationary pivot support member comprises a stationary shaft fastened to and extending laterally from said depending support means, and wherein said paddle blade support means comprises a U-shaped member having a base portion and two upstanding end walls defining registering apertures for freely rotatably receiving the stationary shaft.

4. The improved mixing paddle assembly of claim 1, wherein said stationary pivot support member comprises a stationary shaft fastened to and extending from said depending support means, and wherein said paddle blade support means comprises a blanked and formed stamping defining adjoining, oppositely facing U-shaped portions including a base portion and upstanding intermediate and oppositely disposed end walls each defining registering apertures for freely rotatably receiving the stationary shaft.

5. The improved mixing paddle assembly of claim 3, wherein the said scraper blade is fastened to and supported by the base portion of said U-shaped portions of said paddle blade support member.

6. The improved mixing paddle assembly of claim 4, wherein the said scraper blade is fastened to and supported by the base portion of said paddle blade support member.

7. The improved mixing paddle assembly of claim 3, wherein the rotational stop means comprises an arcuate slot defined by at least one of said end walls and being concentric with and spaced from the respective shaft, receiving apertures and a stationary peg member slidably received by said end wall arcuate slot.

8. The improved mixing paddle assembly of claim 4, wherein the rotational stop means comprises an arcuate slot defined by at least one of said end walls and being concentric with and spaced from the respective shaft, receiving apertures and a stationary peg member slidably received by said end wall arcuate slot.

9. The improved mixing paddle assembly of claim 3, wherein the rotational stop means comprises an arcuate slot defined by each of said end walls, said slot being concentric with and spaced from the respective shaft-receiving apertures and wherein a pair of peg members are each slidably received by a respective end wall arcuate slot, one of said peg members extending laterally from said depending support means and the other extending laterally from an end cap fastened to the said shaft.

10. The improved mixing paddle assembly of claim 3, wherein the rotational stop means comprises an arcuate slot defined by each of said end walls, said slot being concentric with and spaced from the respective shaft-receiving apertures and wherein a pair of peg members are each slidably received by a respective end wall arcuate slot, one of said peg members extending laterally from said depending support means and the other extending laterally from an end cap fastened to the said shaft.

11. A mixing paddle assembly for mixing ingredients of a media contained in a vat having a bottom surface, means for moving said paddle assembly horizontally relative to said vat in alternatively opposed directions and substantially parallel with said bottom surface, said paddle assembly comprising:

a stationary pivot support member;

paddle blade support means pivotally supported by said pivot support member for alternative rotation in opposed arcuate directions depending upon the direction of horizontal movement of said carriage;

rotational stop means for limiting rotation of said paddle blade support in said opposed arcuate directions;

a first and a second scraper blade, each blade being fastened to and supported by said paddle blade support member and laterally spaced from the pivot point defined by said pivot support member; and whereby, during horizontal movement of said paddle assembly moving means in a predetermined horizontal direction, forces exerted by said media against said paddle blade support means and said first scraper blade causes said first scraper blade to rest against the said bottom surface, and wherein horizontal movement in an opposite direction causes the media to force and reverse the blade support means to rotate on its axis to present the second blade for scraping action against said bottom surface.

12. The improved mixing paddle assembly of claim 11, wherein the said stationary pivot support is located forwardly of a respective scraper blade when said blade is resting on said bottom surface.

13. The improved mixing paddle assembly of claim 11, wherein said stationary pivot support member comprises a stationary shaft fastened to and extending laterally from said depending support means, and wherein said paddle blade support means comprises a U-shaped member having a base portion and two upstanding end walls defining registering apertures for freely rotatably receiving the stationary shaft.

14. The improved mixing paddle assembly of claim 11, wherein said stationary pivot support member comprises a stationary shaft fastened to and extending from said depending support means, and wherein said paddle blade support means comprises a blanked and formed stamping defining adjoining, oppositely facing U-shaped portions including a base portion and upstanding intermediate and oppositely disposed end walls each defining registering apertures for freely rotatably receiving the stationary shaft.

15. The improved mixing paddle assembly of claim 13, wherein the said scraper blade is fastened to and supported by the base portion said U-shaped portions of said paddle blade support member.

16. The improved mixing paddle assembly of claim 14, wherein the said scraper blade is fastened to and supported by the base portion said U-shaped portions of said paddle blade support member.

17. The improved mixing paddle assembly of claim 13, wherein the rotational stop means comprises an arcuate slot defined by at least one of said end walls and being concentric with and spaced from the respective shaft, receiving apertures and a stationary peg member slidably received by said end wall arcuate slot.

18. The improved mixing paddle assembly of claim 14, wherein the rotational stop means comprises an arcuate slot defined by at least one of said end walls and being concentric with and spaced from the respective shaft, receiving apertures and a stationary peg member slidably received by said end wall arcuate slot.

19. The improved mixing paddle assembly of claim 13, wherein the rotational stop means comprises an arcuate slot defined by each of said end walls, said slot being concentric with and spaced from the respective shaft-receiving apertures and wherein a pair of peg members are each slidably received by a respective end wall arcuate slot, one of said peg members extending laterally from said depending support means and the other extending laterally from an end cap fastened to the said shaft.

20. The improved mixing paddle assembly of claim 13, wherein the rotational stop means comprises an arcuate slot defined by each of said end walls, said slot being concentric with and spaced from the respective shaft-receiving apertures and wherein a pair of peg members are, each slidably received by a respective end wall arcuate slot, one of said peg members extending laterally from said depending support means and the other extending laterally from an end cap fastened to the said shaft.

21. In a mixing apparatus of the type described, and including a vat having a bottom surface for supporting media to be mixed in said vat, a carriage, means supporting the carriage for horizontal movement in a plane generally parallel with the longitudinal plane of the said bottom surface, support means depending from said carriage for supporting and transporting a mixing paddle assembly in an oscillating movement relative to said vat and during said horizontal movement of the carriage; the combination therewith of an improved mixing paddle assembly comprising:

a stationary shaft fastened to and extending laterally relative to said depending support means, paddle support means defining a pair of oppositely facing U-shaped blade support portions each including a base portion, a common intermediate wall and a pair of end walls, the intermediate wall and the end walls being apertured to freely and rotatably receive and be pivotally supported by said stationary shaft, said end walls each defining an arcuate slot concentric with a spaced from said aperture, an end cap extending substantially normal to the axis of said shaft, and including a laterally extending peg disposed in the arcuate slot of one of said end walls to act as a rotational stop means for said pivotally supported blade support means, a peg supported by and laterally extending from said depending support means and extending into the arcuate slot of the other end wall, a scraper blade fastened to a respective one of said base portions of said oppositely facing U-shaped portions, and whereby, during horizontal movement of said carriage, forces exerted by said media against said base portion and said scraper blade rearwardly spaced from said pivotably supporting shaft causes said scraper blade to rest against the said bottom surface, and whereby said pegs cooperate with the respective slots to restrict rotational motion of said paddle support means to cause lifting of media ingredients resulting in a vertical stirring action of the media, and whereby horizontal movement of said carriage in the opposite direction causes said blade support member to rotate about the shaft to permit its respective, oppositely disposed scraper blade to rest against the said bottom surface.

* * * * *